US005231423A

United States Patent [19]

Wataya et al.

[11] Patent Number: 5,231,423

[45] Date of Patent: Jul. 27, 1993

[54] INK JET RECORDING APPARATUS WITH HEAT EXCHANGE MEANS

[75] Inventors: Masafumi Wataya, Kawasaki; Hidejiro Kadowaki, Yokohama; Ken Tsuchii; Toshiyuki Yanaka, both of Tokyo; Kosuke Yamamoto; Haruhiko Takahashi, both of Yokohama; Makoto Takamiya; Yasushi Miura, both of Kawasaki; Masami Izumizaki, Tokyo, all of Japan

[73] Assignee: Canon Kabushiki Kaisha, Tokyo, Japan

[21] Appl. No.: 780,453

[22] Filed: Oct. 22, 1991

Related U.S. Application Data

[63] Continuation of Ser. No. 600,200, Oct. 19, 1990, abandoned.

[30] Foreign Application Priority Data

Oct. 20, 1989 [JP] Japan ..... 1-271555
Oct. 20, 1989 [JP] Japan ..... 1-271556
Oct. 20, 1989 [JP] Japan ..... 1-271557

[51] Int. Cl.[5] ..... B41J 2/05; B41J 29/377

[52] U.S. Cl. ..... 346/140 R; 165/104.33; 361/384

[58] Field of Search ..... 346/140 R; 165/104.33; 361/384–381

[56] References Cited

U.S. PATENT DOCUMENTS 4,313,124 1/1982 Hara .
4,345,262 8/1982 Shirato et al. .
4,459,600 7/1984 Sato et al. .
4,463,359 7/1984 Ayata et al. .
4,521,805 6/1985 Ayata ..... 358/296 X
4,544,931 10/1985 Watanabe ..... 346/140 R
4,558,333 12/1985 Sugitani et al. .
4,692,777 9/1987 Hasumi ..... 346/140 R
4,723,129 2/1988 Endo et al. .
4,740,796 4/1988 Endo et al. .
4,819,011 4/1989 Yokota ..... 346/76 PH

FOREIGN PATENT DOCUMENTS 54-056847 5/1979 Japan .
59-123670 7/1984 Japan .
59-138461 8/1984 Japan .
60-071260 4/1985 Japan .

*Primary Examiner*—Joseph W. Hartary
*Attorney, Agent, or Firm*—Fitzpatrick, Cella, Harper & Scinto

[57] ABSTRACT

An ink jet recording apparatus for effecting recording with ink that adheres to a recording medium has an ink jet recording head unit having a recording head in which a plurality of electrothermal conversion elements available to discharge the ink are arranged, a heat exchange device having a first heat exchange portion contacting with the whole area of one side of the recording head in the lengthwise direction thereof and effecting heat exchange and a second heat exchange portion provided in continuation to the first heat exchange portion and extending on the outside far from the recording head, a heater provided near the second heat exchange portion for heating the heat exchange device, and a temperature detector provided on a portion of the first heat exchange portion; the second heat exchange portion being inclined upwardly relative to the recording head; a cooling device for acting on the second heat exchange portion of the heat exchange device and assisting the heat radiation of the second heat exchange portion; and drive controller for controlling the driving of the cooling device and/or the heating device on the basis of the temperature detected by the temperature detector.

11 Claims, 10 Drawing Sheets

INK JET RECORDING APPARATUS WITH HEAT EXCHANGE MEANS

This application is a continuation of application Ser. No. 07/600,200 filed Oct. 19, 1990, now abandoned.

BACKGROUND OF THE INVENTION

1. Field of the Invention

This invention relates to an ink jet recording apparatus for effecting recording with ink caused to adhere to a recording medium.

2. Related Background Art

Ink jet recording apparatuses in which ink is discharged from a recording head and caused to adhere to a recording medium to thereby effect the recording of information such as characters and images are known.

Apparatuses of this kind use chiefly paper or plastic sheets as a recording medium, and particularly are small in operation noise as compared with the other recording systems and are simple and inexpensive in their basic mechanical construction, and have been widely adopted as various recording output apparatuses of computers, word processors, etc.

In the apparatuses of this kind, however, a change in the discharge state of ink immediately appears in the form of the disturbance of recorded images and therefore, to effect image recording stably, it is important to stabilize the discharge state of ink. Now, the discharge state of ink depends greatly on the viscosity of the ink in the discharge port forming portion (hereinafter referred to as the discharge ports) of a recording head, and the production process and maximum volume of a bubble produced by a phase change in the ink when heat energy is applied to the ink. Further, the change in the viscosity of the ink depends on the time of the non-recording operation and the temperature of the ink, and the production process and maximum volume of the bubble also depend chiefly on the temperature of the ink and therefore, to finally stabilize the discharge state of the ink, it becomes important to control the temperature of the ink.

So, the applicant has proposed, as a system for uniformizing the temperature of the recording head and controlling the temperature of the ink, to mount a heat pipe on a side of the recording head, and effect the heating or heat radiation of the recording head through the heat pipe in accordance with the temperature of the recording head. Thereby it has been possible to effect the uniform temperature control of particularly the whole area of the so-called full line type recording head in which discharge ports are arranged along the recording width of recording paper.

FIG. 1 of the accompanying drawings shows an example of the prior art. In FIG. 1, the reference numeral 227 designates a recording medium which is conveyed in the direction of arrow A by conveying means, not shown. A recording head 221 is joined to a heat pipe 205 along the direction of arrangement of electro-thermal conversion members, and ink discharge ports, not shown, faced in a direction opposed to the recording medium 227. Ink is discharged from the discharge ports to the recording medium 227 in conformity with an image signal, whereby an image is recorded on the recording medium. The reference numeral 209 denotes a fan for blowing wind to fins 206 in accordance with the command of a control circuit 211. A temperature sensor 210 is mounted between the vicinity of the center of the heat pipe 205 and a support member 201 to detect temperature. The control circuit 211 is connected to the temperature sensor 210 and receives the temperature detected by the temperature sensor 210. The control circuit 211 is also connected to a heater 207 and the fan 209, and adjusts the input electric power to the heater 207 and the fan 209 or the ON-OFF time interval in accordance with the temperature detected by the temperature sensor 210.

However, the heat pipe is limited in its heat transporting ability, which depends on the size of the heat pipe. Relative to the heat transporting ability of the heat pipe mounted on the full line type recording head, the amount of heat produced from the recording head may become very great in some cases, depending on the kind of recorded image. That is, in some cases, the amount of heat generated by the recording head is over the maximum heat transport amount of the heat pipe. Particularly, where the recording head and heat radiation means attached to the heat pipe for radiating the heat of the recording head through the heat pipe are located at the same height, the evaporation speed of working fluid present on the inner surface of the heat pipe becomes great and the circulation of the working fluid becomes useless and there may be caused a phenomenon that the layer of the working fluid is divided into sections in the overheated portion thereof. This phenomenon is called dry-out, and when the working fluid is locally divided into sections, the circulation of the working fluid will no longer take place and the accumulation of heat will occur.

If the accumulation of heat occurs like this, the temperature of the recording head will rise and the non-uniformity of the temperature will occur in the lengthwise direction and thus, the temperature of the ink will become irregular and normal ink discharge will no longer take place, and density irregularity will occur to make it impossible to keep recorded images uniform and accomplish recording of high quality.

SUMMARY OF THE INVENTION

The present invention has been made in view of the above-noted technical tasks, and an object thereof is to provide an image recording apparatus in which the occurrence of dry-out is prevented to make the uniformization of the temperature of a recording head possible and thereby recording an image of high quality free of density irregularity to be accomplished.

Also, the present invention has been made in view of the above-noted problems, and an object thereof is to provide an ink jet recording apparatus which can quickly return from the "dry-out" state and can accomplish normal recording.

Another object of the present invention is to provide an ink jet recording apparatus having:

an ink jet recording head unit having a recording head in which a plurality of electro-thermal conversion elements available to discharge ink are arranged, heat exchange means having a first heat exchange portion contacting with the whole area of one side of said recording head in the lengthwise direction thereof and effecting heat exchange and a second heat exchange portion provided in continuation to said first heat exchange portion and extending on the outside far from said recording head, heating means provided near said second heat exchange portion for heating said heat exchange means, and temperature detecting means provided on a portion of said first heat exchange portion;

said second heat exchange portion being inclined upwardly relative to said recording head;

cooling means for acting on said second heat exchange portion of said heat exchange means and assisting the heat radiation of said second heat exchange portion; and drive control means for controlling the driving of said cooling means and/or said heating means on the basis of the temperature detected by said temperature detecting means;

said apparatus effecting recording with the ink caused to adhere to a recording medium.

Still another object of the present invention is to provide an ink jet recording apparatus having:

an ink jet recording head unit having a recording head in which a plurality of electro-thermal conversion elements available to discharge ink are arranged, heat exchange means having a first heat exchange portion contacting with the whole area of one side of said recording head in the lengthwise direction thereof and effecting heat exchange and a second heat exchange portion provided in continuation to said first heat exchange portion and extending on the outside far from said recording head, and a plurality of temperature detecting means provided in the area in which said first heat exchange portion exists; and recovery means available to forcibly discharge the ink in said recording head when the temperatures detected by said plurality of temperature detecting means exceed a predetermined value;

said apparatus effecting recording with the ink caused to adhere to a recording medium.

Yet still another object of the present invention is to provide an ink jet recording apparatus having;

an ink jet recording head unit having a recording head in which a plurality of electro-thermal conversion elements available to discharge ink are arranged, heat exchange means having a first heat exchange portion contacting with the whole area of one side of said recording head in the lengthwise direction thereof and effecting heat exchange and a second heat exchange portion provided in continuation to said first heat exchange portion and extending on the outside far from said recording head, and a plurality of temperature detecting means provided in the area in which said first heat exchange portion exists; and recording speed control means for varying the recording speed of said recording head when the temperatures detected by said plurality of temperature detecting means exceed a predetermined value;

said apparatus effecting recording with the ink caused to adhere to a recording medium.

When during the recording operation, heat-operated fluid in a heat pipe gasified by the heat of the recording head which generates heat is condensed into liquid by heat radiation means provided on the end portion of the heat pipe, the liquefied heat-operated fluid readily moves toward the recording head which is a heat generating portion below because the end portion of the heat pipe on which the heat radiation means is provided is bent upwardly from the portion thereof which is mounted to the recording head, and the movement of the heat-operated fluid becomes active and the probability with which dry-out occurs in the heat pipe becomes very low and even if the dry-out occurs, the movement of the heat-operated fluid is recovered naturally and the heat transporting power is maintained.

Also, it has been obtained as experimental data that in a state in which the heat pipe is acting normally, the difference between the temperatures detected by the plurality of temperature sensors is very stable within a predetermined range. When this temperature difference exceeds a predetermined amount, the control means judges that the heat pipe is in dry-out state, and forcibly pressurizes the ink in the recording head from the outside and causes the ink to be discharged to thereby reduce the temperature of the recording head and cool the heat pipe, thus reversing the relation between the liquefying speed and the evaporation speed of the working fluid and recovering the continuous state of the working fluid to thereby restore the ordinary state of use.

Further, during the recording operation, the temperatures of the recording head are detected at a plurality of locations and the heating or heat radiation of the recording head is effected through the heat pipe and also, the difference between the detected temperatures is found, and if the temperature difference exceeds a predetermined temperature difference, the printing speed is varied to cause a reduction in the temperature of the recording head. Thereby, the circulating condition of the working fluid in the heat pipe is normalized to thereby recover the ability of the heat pipe. It should be noted that when the temperature is detected by the temperature detecting element disposed in the heat pipe, the heat transporting amount of the heat pipe can be grasped from the detected temperature.

Also, the case where the printing speed is changed refers to a case when the conveyance interval of recording sheets or the printing frequency is varied and like case, and in any of these cases, the driving interval of the electro-thermal conversion elements of the recording head varies and the amount of heat generated by the recording head can be controlled.

DESCRIPTION OF THE PREFERRED EMBODIMENTS

Some embodiments of the present invention will hereinafter be described with reference to the drawings.

Figure 1:
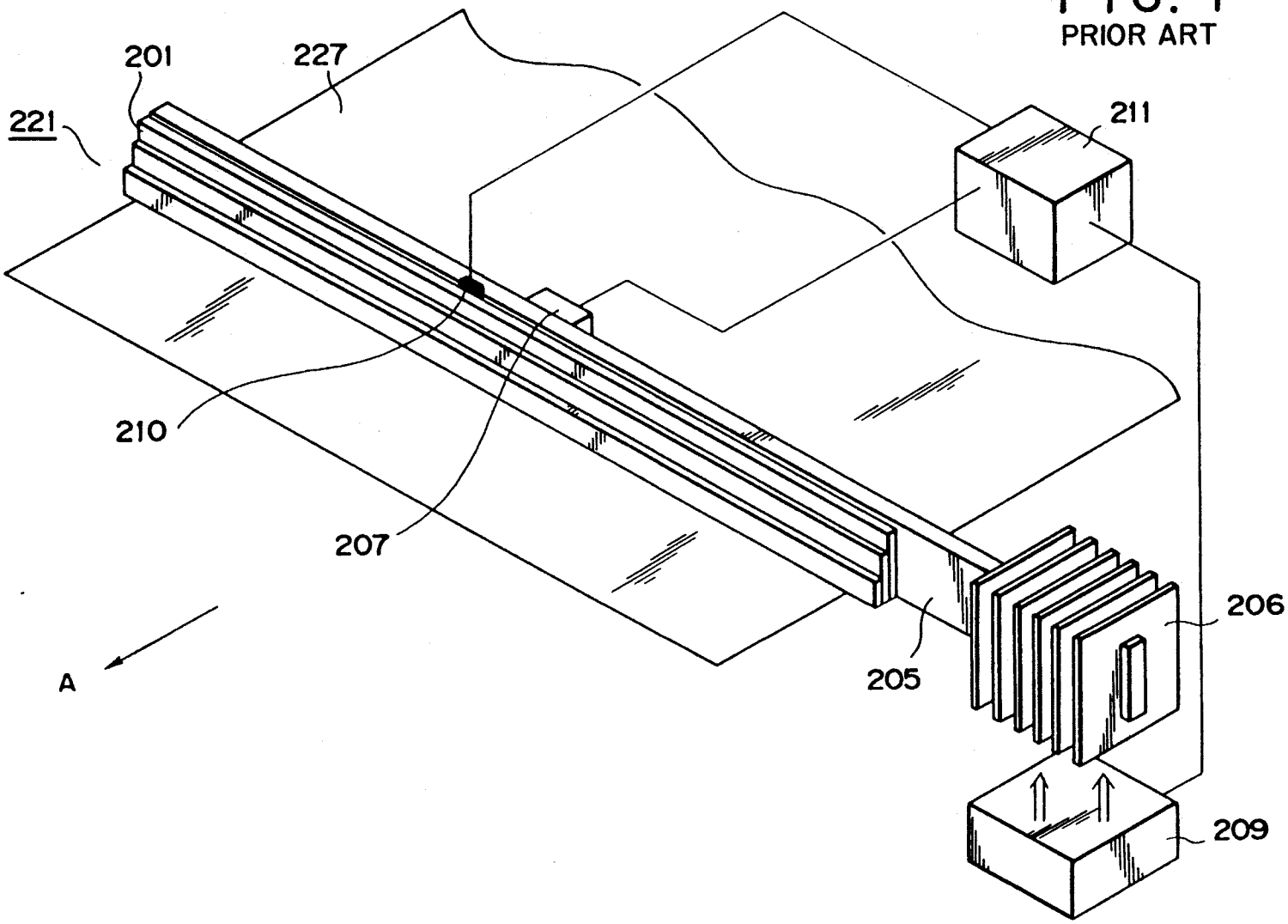
FIG. 1 PRIOR ART
FIG. 1 is a schematic perspective view showing a basic heat pipe as it is mounted on a recording head.
Figure 2:
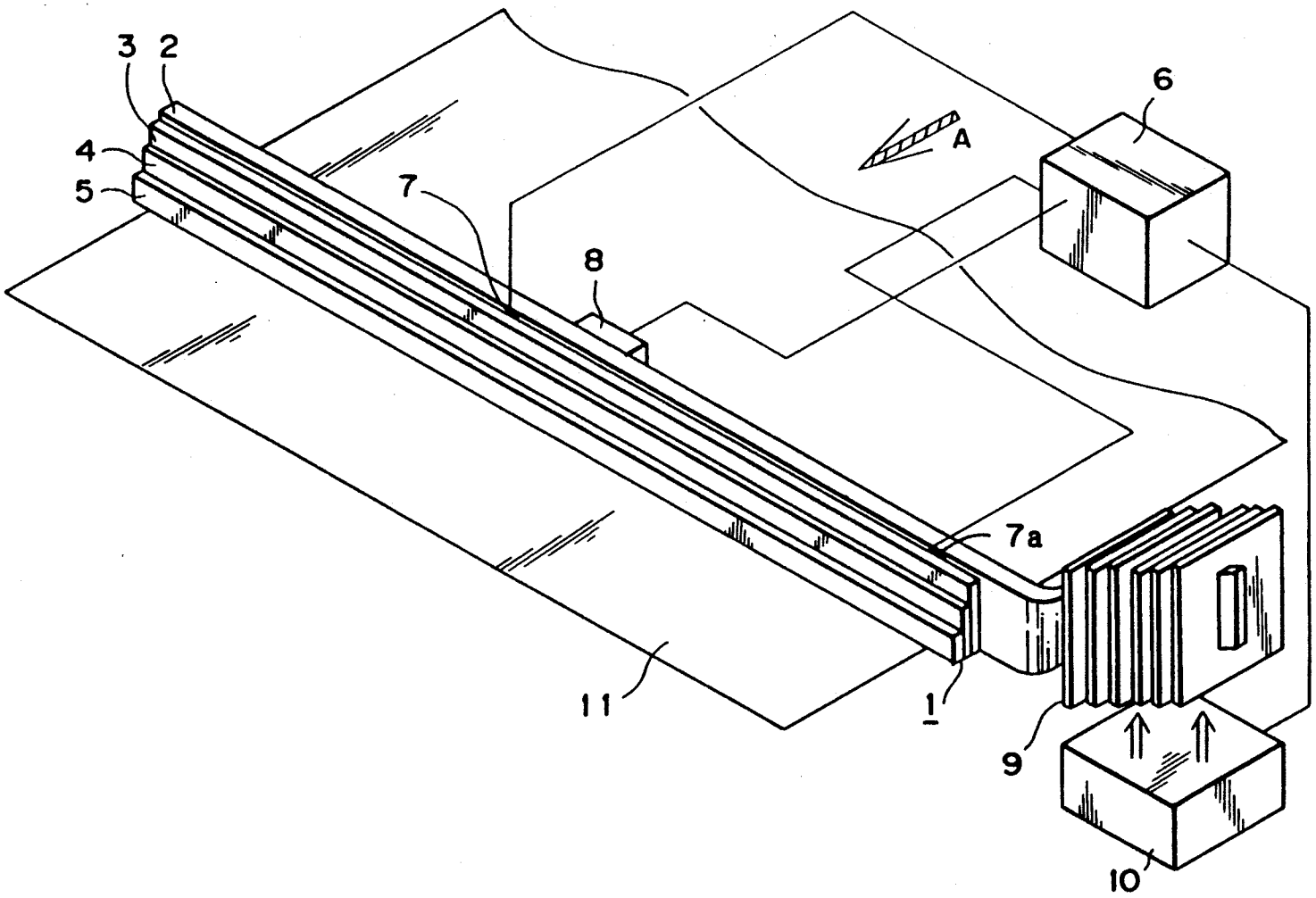
FIG. 2 is a perspective view schematically showing the construction of an embodiment of the present invention.

FIG. 2 is a perspective view showing an embodiment of the present invention.

In the image recording apparatus of the present embodiment, a recording head 1 having a heat pipe 2 mounted thereon at a position in a direction intersecting the direction of conveyance A and opposed to the recording head is disposed above a recording medium 11 conveyed in the direction of conveyance A by conveying means, not shown.

The recording head 1 is such that a substrate member 4 on which a plurality of electro-thermal conversion elements, not shown, are juxtaposed in the lengthwise direction is adhesively secured to a support member 3 and further, an ink chamber 5 in which a plurality of discharge ports are juxtaposed in the lengthwise direction and which is provided with a common liquid chamber for supplying ink to the discharge ports through ink flow paths is mounted on the substrate member 4. This recording head 1 is of such a construction that at least one electro-thermal conversion element is likewise correspondingly disposed for each discharge port and ink is suitably supplied from an ink reservoir, not shown, to the common liquid chamber of the ink chamber 5 and heat energy generated by the electro-thermal conversion elements being driven by an image signal from a printing control unit, not shown, is utilized to cause a state change in the ink, whereby the ink is discharged from a desired discharge port to form an image on the recording medium 11.

Further, the recording head 1 has integrally mounted thereon the heat pipe 2 bent at one end thereof and having heat radiation fins 9 mounted on the bent portion.

The heat pipe 2 in the present embodiment has a length greater than the length of the recording head 1, and one end thereof is bent so as to be positioned above the portion of the heat pipe 2 which contacts the recording head 1 when the heat pipe 2 is mounted on the recording head 1. Further, a heater 8 is mounted on the heat pipe 2 in the portion thereof which corresponds to the central portion of the recording head 1. This heat pipe 2, as shown in FIG. 2, is mounted on the recording head 1 in such a manner that the end portion thereof having the heat radiation fins 9 mounted thereon protrudes sideways of the recording head 1 and the heat radiation fins 9 are positioned above the portion of the heat pipe 2 which contacts the recording head 1.

Also, a temperature sensor 7 is disposed on that portion of the heat pipe 2 which is adhesively secured to the recording head 1 and which corresponds to the central portion of the recording head 1 so that on the basis of the temperature detected by the temperature sensor 7, a controller 6 may drive the heater 8 or a fan 10 provided below the heat radiation fins 9 and effect heat exchange through the heat pipe 2 to thereby keep the recording head 1 at a predetermined temperature.

The operation of the present embodiment will now be described.

When a switch, not shown, for instructing the apparatus to start the recording operation is first closed, the temperature sensor 7 detects the temperature of the recording head 1. This is before the recording operation is performed and therefore, the temperature of the recording head 1 has not yet reached said predetermined temperature, and the controller drives the heater 8, which thus heats the recording head 1 through the heat pipe 2.

Heat-operated fluid in the heat pipe 2 is evaporated by this heating from the heater 8 and spreads uniformly in the heat pipe 2 and emits latent heat. At this time, that surface side of the heat pipe 2 which is adhesively secured to the support member 3 of the recording head 1 is low in temperature and therefore provides a condensing portion, and condenses the evaporated and spread heat-operated fluid and thus receives a uniform heat flow flux, whereby the temperature of the recording head 1 rises uniformly.

Figure 3:
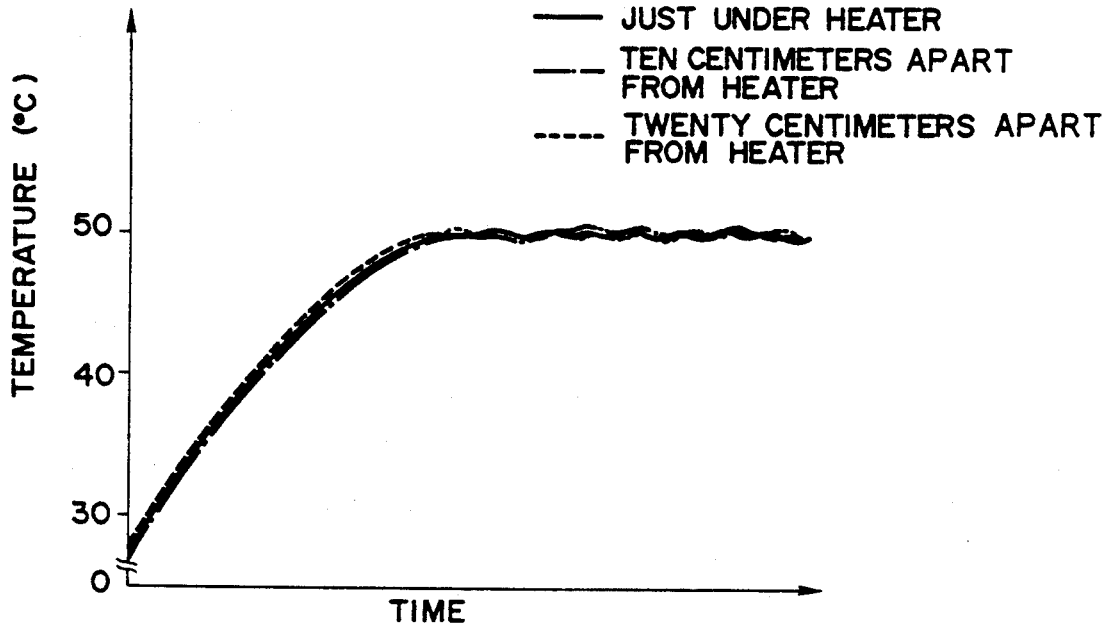
FIG. 3 is a characteristic graph showing a variation in the temperature of the heat pipe when the image recording apparatus shown in FIG. 2 starts recording.
Figure 4:
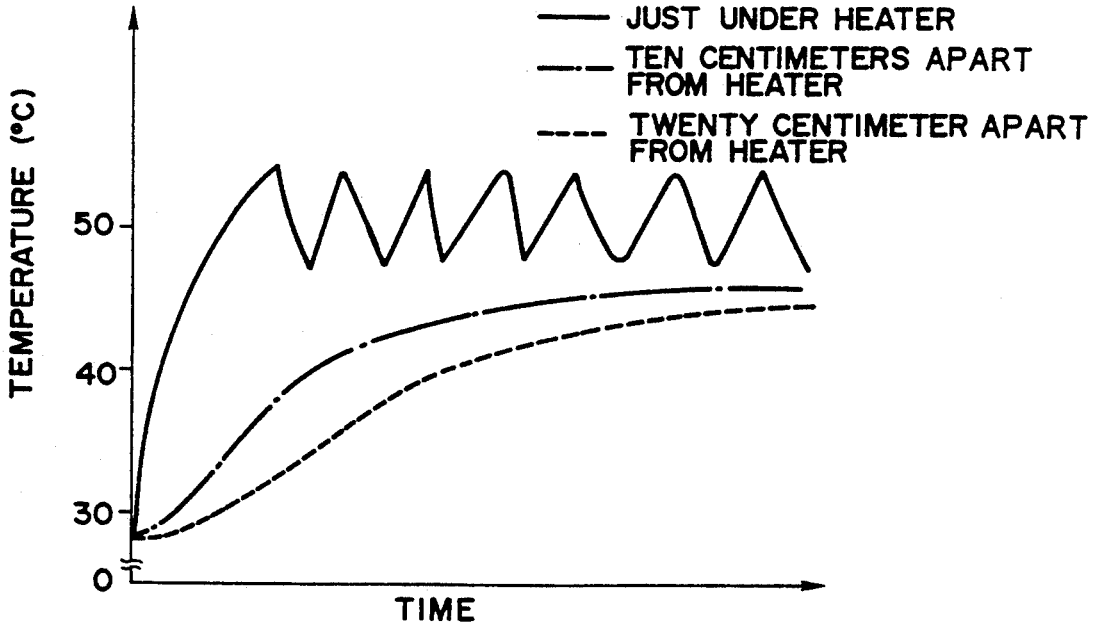
FIG. 4 is a characteristic graph showing a variation in temperature when an aluminum substrate is used in the heat pipe in the recording apparatus shown in FIG. 2.

The actual measurement data of the variation in temperature in the lengthwise direction of the support member 3 by this heating measured at a plurality of locations on the support member 3 is shown in FIG. 3. Also, the actual measurement data obtained under the same conditions by the use of an aluminum substrate of the same size as the heat pipe 2, instead of the heat pipe 2, is shown in FIG. 4.

In both of these figures, the abscissa represents the time from after the heater 8 is turned on and the ordinate represents the temperature of the surface of the support member 3 which is adhesively secured to the heat pipe 2. The measurement of the temperature has been effected at a position just under the heater 8, at a position lengthwisely far by 10 cm from the position just under the heater 8, and at a position lengthwisely far by 20 cm from the position just under the heater 8, and the predetermined temperature is 50° C. and the heater 8 is suitably turned on and off so that the temperature at the position just under the heater may be 50° C. Room temperature is 28° C., and before the heater 8 is turned on, the temperature of the support member 3 is the same as the room temperature. As is apparent from FIGS. 3 and 4, when the heat pipe 2 of the present embodiment is used, the ideal heating temperature control of the support member 3 is achieved. That is, where an aluminum substrate is used as heat accumulation preventing and temperature uniformizing means for the recording head, a temperature difference of the order of maximum 10° C. occurs in the lengthwise direction as shown in FIG. 4, whereas when the heat pipe 2 is used, little or no temperature difference occurs in the lengthwise direction as shown in FIG. 3. Further, as regards the variation of temperature occurring when the heater 8 is turned on and off, where the aluminum substrate is used, there is exhibited temperature variation of approximately ±7°-8° C. about the predetermined temperature (50° C.) as shown in FIG. 4, whereas when the heat pipe 2 is used, the temperature variation can be suppressed within ±1° C. as shown in FIG. 3.

When in the manner described above, the temperature of the recording head 1 reaches the predetermined temperature, the amount of ink in the discharge ports 12 is adjusted by recovery means, not shown, and the recording medium 11 is conveyed in the direction of conveyance A by conveying means, not shown. When the recording medium 11 arrives at a location opposed to the discharge ports 12 of the recording head 1, heat energy is applied to the ink in accordance with an image signal and the ink is discharged from the discharge ports 12. The discharged ink is absorbed by the opposed recording medium 11 when it arrives at the latter, and forms an image.

Now, as this image formation progresses, the recording head 1 is raised in temperature by that part of the heat energy applied to the ink which remains in the recording head 1, and the temperature of the support member 3 also rises. When the temperature detected by the temperature sensor 7 rises from the predetermined temperature by an allowable amount or more, the controller 6 switches on the fan 10, which thus blows wind against the heat radiation fins 9 and thus, the heat radiation of the recording head 1 is started through the heat pipe 2. At this time, that portion of the heat pipe 2 which is adhesively secured to the support member 3 is at a high temperature and therefore provides a so-called evaporating portion, and much heat-operated fluid is evaporated from that portion of the heat pipe into which a great deal of heat flow flux flows from the support member 3, i.e., the high temperature portion, and a small amount of heat-operated fluid is evaporated from that portion of the heat pipe into which a small amount of heat flow flux flows, i.e., the low temperature portion, and amounts of heat conforming to the respective amounts of evaporation are taken away to make the heat-operated fluid into vapor. Also, that portion of the heat pipe into which no heat flow flux flows provides a condensing portion and therefore, the heat-operated fluid that has once been made into vapor is condensed thereby, and the then latent heat is absorbed by the condensing portion. The vapor portion of the heat-operated fluid has no heat resistance and the travel of heat takes place in a moment therein and therefore, the uniformization of the interface temperature between the heat-operated fluid in the evaporating portion and the vapor portion is effected momentarily, and this interface temperature is maintained substantially uniform even if the heat flow flux has locational irregularity. Accordingly, even if a heat flow flux having locational irregularity flows into the support member 3 in conformity with an image signal, the support member 3 is kept at a uniform temperature by the temperature uniformizing action in the heat pipe 2. Any surplus amount of heat still after the uniformization of the interface temperature is carried to the heat radiation fins 9 in a moment and condensed thereby to generate an amount of heat. The thus generated amount of heat is transferred through the heat radiation fins 9 to the air stream supplied from the fan 10 and is discharged into the air. At this time, in that end portion of the heat pipe 2 on which the heat radiation fins 9 are mounted, the condensed heat-operated fluid restores its liquid phase, and the heat-operated fluid now in its liquid phase readily flows through the wick in the heat pipe 2 toward the recording head 1 at a lower position which provides the heat generating portion, because said end portion is bent and lies at a higher position than the recording head 1. The fluid is again made into vapor by the heat of the recording head 1 and is carried to the heat radiation fins 9, whereby heat is radiated, and by the repetition of these processes, the heat radiation effect is more improved.

Figure 5:
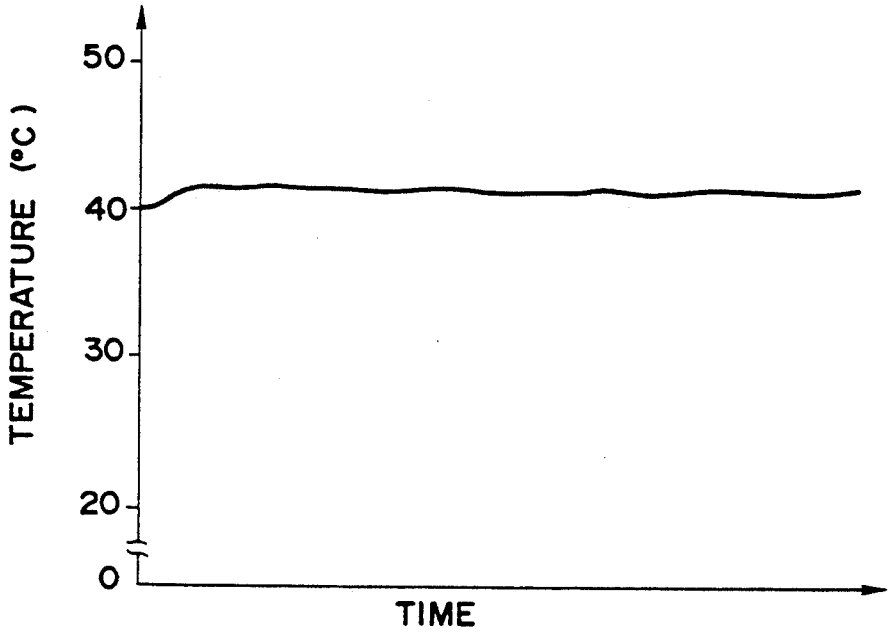
FIG. 5 is a graph showing a variation in temperature when discharge is effected from all orifices of the recording head in the recording apparatus shown in FIG. 2.
Figure 6:
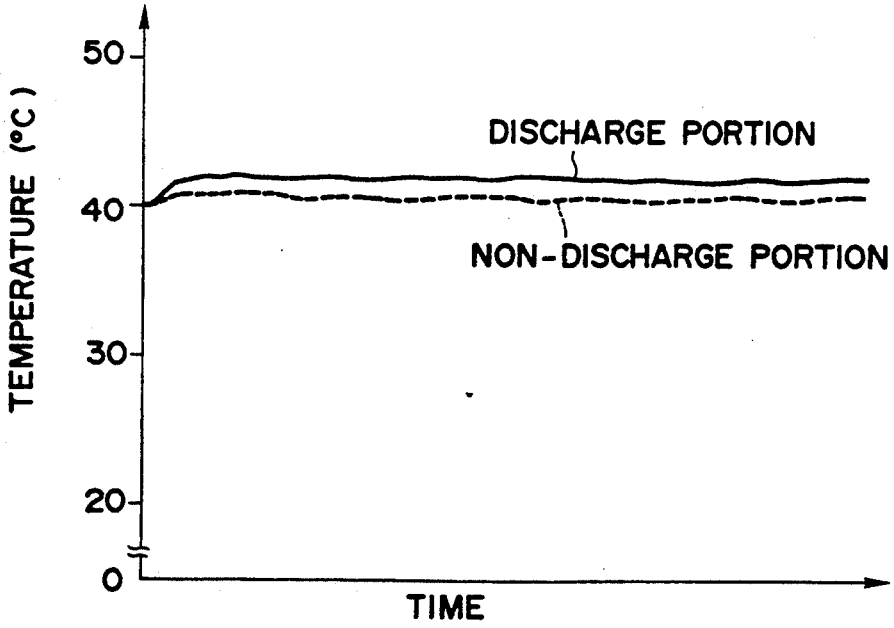
FIG. 6 is a graph showing the temperature when discharge is effected from one half of the orifices of the recording head in the recording apparatus shown in FIG. 2.

FIG. 5 shows the actual measurement data when the fan 10 is suitably switched on and off to control the temperature of the support member 3 to the vicinity of the predetermined temperature by proper heat radiation when the recording head is caused to effect full discharge, and FIG. 6 shows similar actual measurement data when one half of the discharge ports of the recording head 1 and rendered into discharge state and the other half of the discharge ports are rendered into non-discharge state. In both of these figures, the abscissa represents time and the ordinate represents the interface temperature between the support member 3 and the heat pipe 2. Room temperature is 26° C., and the point of time at which the discharging operation is started after the support member 3 is heated by the heater 8 and controlled to 40° C. is taken as the origin. The fan 10 is switched on when the temperature of the support member 3 exceeds 41° C., and is switched off when the temperature of the support member 3 is 41° C. or less.

Now, in the case of full discharge, as shown in FIG. 5, the fan 10 is suitably turned on and off, whereby the temperature of the support member can be substantially stably maintained at a predetermined temperature. Of course, in this case, the support member has little or no temperature irregularity in the lengthwise direction thereof. Next, in the case of half discharge and half non-discharge, as shown in FIG. 6, the temperature of the support member 3 is stably maintained at a temperature difference of the order of 1° C. This temperature difference is due to the heat resistance of the so-called wick in the heat pipe 2 and the interface between the vapor and the heat-operated fluid is at a uniform temperature, but this temperature difference on the surface of the heat pipe 2 across the wick. However, this temperature difference of 1° C. in the support member 3 between the non-discharge portion and the discharge portion poses substantially no problem in image recording and in this sense, the temperature of the support member 3, i.e., the recording head 1, can be ideally controlled substantially uniformly if the heat radiation of the recording head 1 is effected through the heat pipe 2. During the image recording operation, the controller 6 suitably switches on and off the fan 10 in accordance with the temperature detected by the temperature sensor 7, whereby the temperature of the support member 3 can be substantially uniformly and stably maintained at the vicinity of the predetermined temperature, as described above.

As described above in detail, by the heat pipe 2 being mounted on the recording head 1, and the recording head 1 being heated or heat-radiated through the heat pipe 2 in accordance with the temperature of the recording head 1, it becomes possible to keep the long recording head uniformly at the predetermined temperature. Thus, the ink discharge condition becomes greatly stable and the stability of images is greatly improved.

Further, in the present embodiment, the heat radiation fins 9 and fan 10 are installed outside the recorded image area and therefore, the strong air stream from the fan 10 can be separated from the image area and heat radiation can be effected without disturbing the flight course of discharged ink, whereby the stability of images is further enhanced.

In the present embodiment, one end portion of the heat pipe is upwardly bent, but alternatively, both end portions of the heat pipe may be upwardly bent.

Also, the heat pipe of such a shape as shown in the present embodiment may be provided by a pre-bent pipe, or may be bent after a straight type is made.

By one end of the heat pipe being thus upwardly bent, there can be provided a construction in which the working fluid can be readily returned to the heat generating area, and the circulation of the working fluid can be accomplished better. Accordingly, by the aforedescribed construction being adopted, the dry-out phenomenon which is ready to occur when the amount of heat generated by the recording head is very great and localized overheat occurrences can be minimized by the forced circulation or returning action of the working fluid.

The return of the working fluid to the heat generating area can also be accomplished well by forming an inclined area on the inner surface of the cooling portion side of the heat pipe as the construction of the inner surface of the heat pipe and therefore, a similar effect can be obtained.

Also, a construction in which the forced circulation of the working fluid can be created may be adopted instead of the construction in which one end of the heat pipe is upwardly bent, and for example, use may be made of a construction in which the heat pipe itself is slightly inclined with respect to the recording head 1 and mounted on the latter. In this case, it is preferable to mount the heat pipe with the condensing portion thereof for the working fluid being above in the direction of gravity so that the working fluid can move well to the area in which overheat is ready to occur. This inclination may be slight to obtain the forced circulation of the working fluid sufficiently, and can well suppress the occurrence of dry-out.

As described above, the present invention has the following effects.

One end portion of the heat pipe mounted on the recording head is upwardly bent from that portion thereof which is mounted on the recording head and the heat radiation means is provided on the bent portion and therefore, the movement of the heat-operated fluid from the heat radiation portion to the area of the heat pipe which is joined to the recording head which provides the heat generating portion during the recording operation can take place easily and reliably and thus, it becomes very difficult for the dry-out phenomenon to occur. Thereby, the apparent amount of heat transported by the heat pipe can be increased.

The uniformization of the movement of the heat-operated fluid is improved by the increase in the amount of heat transported by the heat pipe and therefore, the temperature adjusting effect such as the heating or the heat radiation of the recording head effected through the heat pipe is improved and highly accurate and stable temperature control of the recording head becomes possible and thus, the temperature difference in the recording head becomes null and the ink discharge condition becomes stable, and image recording of high quality free of density irregularity can be accomplished.

Where the bent portion of the heat pipe protrudes sideways of the recording head, the heat radiation means is located outside the recording liquid discharging area of the recording head and therefore, the disturbance of the flight course of the recording liquid by the blower included in the heat radiation means is eliminated and the reliability of image formation is further improved.

Another embodiment of the present invention shown in FIG. 7 will now be described.

Figure 7:
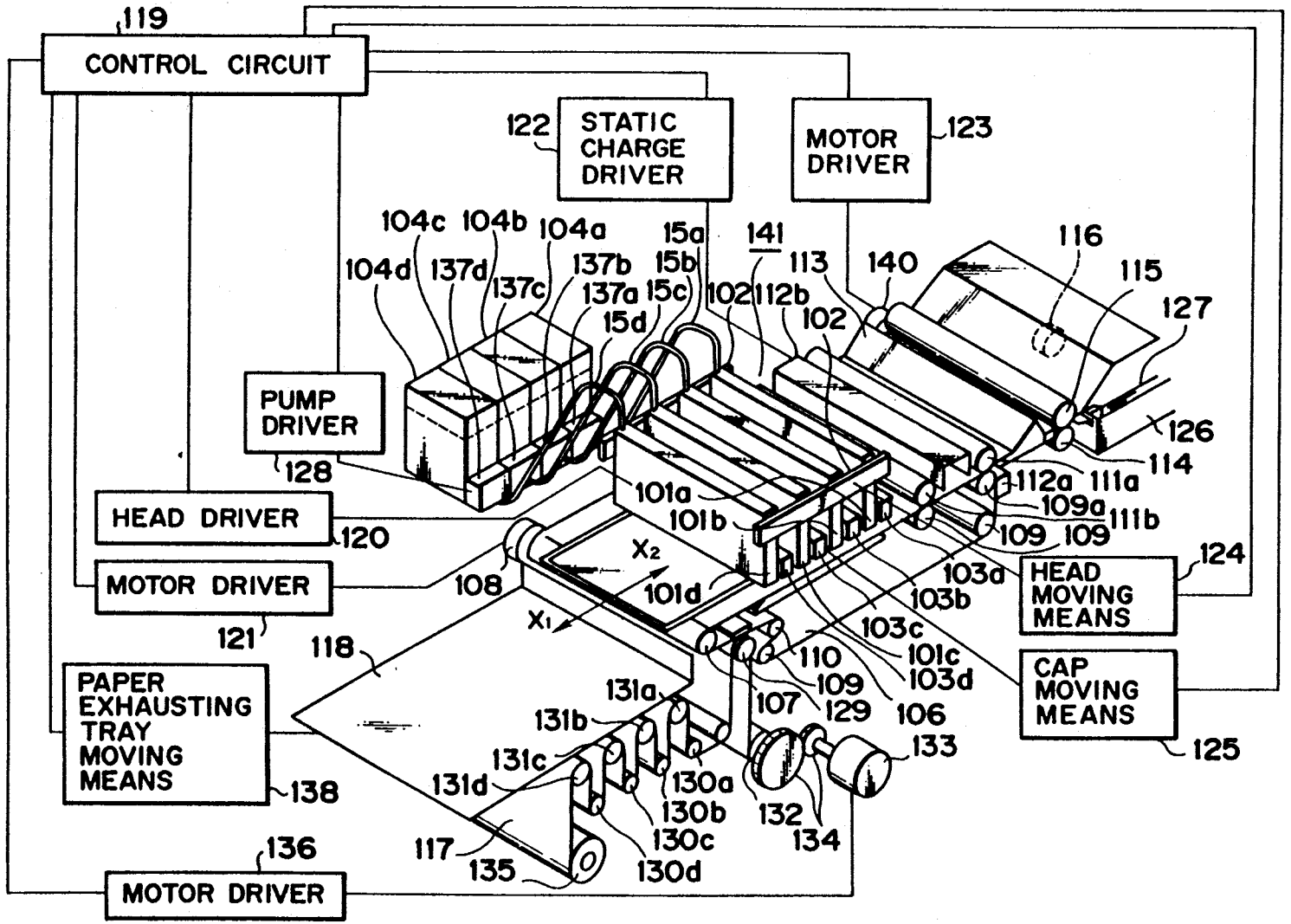
FIG. 7 is a perspective view schematically showing the construction of another embodiment of the present invention.

This embodiment incorporates therein a heat pipe, a temperature sensor, fins, a fan and a heater which will be described later, but the details thereof similar to those of the aforedescribed first embodiment and in FIG. 7, are omitted. Also, FIG. 7 is for illustrating a series of movements in the recovery operation performed when dry-out occurs.

In FIG. 7, the reference characters 101*a*, 101*b*, 101*c* and 101*d* designate recording heads. The four recording heads 101*a*, 101*b*, 101*c* and 101*d* each are provided with 3,456 nozzles, not shown, at intervals of 16 dots/mm in the underside thereof, and successively effect recording over a width of 216 mm for each line. The recording heads 101*a*, 101*b*, 101*c* and 101*d* correspond to four colors, i.e., black, cyan, magenta and yellow, respectively, and are fixedly held on a holder 102 so that the intervals between the nozzles in the direction of arrow $X_1$ which is the direction of conveyance of recording paper may be constant. A head unit 141 comprised of the recording heads 101*a*, 101*b*, 101*c*, 101*d* and the holder 102 is movable in the vertical direction and the directions of arrows $X_1$ and $X_2$ by head moving means 124. The reference characters 103*a*, 103*b*, 103*c* and 103*d* denote caps capped on discharge ports, not shown, which form the nozzles of the recording heads 101*a*, 101*b*, 101*c* and 101*d* during non-recording. These caps 103*a*, 103*b*, 103*c* and 103*d* are made of silicon rubber and can seal the discharge port surface by the utilization of the elasticity thereof. The reference characters 104*a*, 104*b*, 104*c* and 104*d* designate ink tanks corresponding to the recording heads 101*a*, 101*b*, 101*c* and 101*d* , respectively, and ink is directed to the recording heads 101*a*, 101*b*, 101*c* and 101*d* via ink supply tubes 15*a*, 15*b*, 15*c* and 15*d*. The supply of ink utilizes the capillary phenomenon of the nozzles of the recording heads 101*a*, 101*b*, 101*c* and 101*d*, and the water head of the ink in each of the ink tanks 104*a*, 104*b*, 104*c* and 104*d* is set to a predetermined distance lower than the nozzle surface. The reference characters 137*a*, 137*b*, 137*c* and 137*d* denote ink circulating pumps for supplying the ink under pressure into the recording heads 101*a*, 101*b*, 101*c* and 101*d*. The reference numeral 106 designates a seamless belt (hereinafter referred to as the belt) for conveying a recording sheet 127. The belt 106 has a high resistance layer (of the order of $10^{14}\Omega$cm) of a thickness of the order of 50 μm on the surface thereof, and the inner surface thereof is earthed by idle rollers 109 and 109*a*, and the surface thereof is charged to the order of 1500 V by a static charger 112*a*. The recording sheet 127 has negative charges introduced thereinto by a static charger 112*b* and is electrostatically attracted to the surface of the belt 106, whereby it is conveyed. The belt 106 is rotated in a direction to move the recording paper 127 in the direction of arrow $X_1$ by a belt motor 108 (hereinafter referred to as the motor 108) connected to a belt driving roller 107. The reference numeral 109 denotes an idle roller for pulling around the belt 106, and the reference numeral 110 designates a tension roller for imparting predetermined tension to the belt 106. The reference characters 111*a* and 111*b* denote pinch rollers for urging the recording paper 127 against the belt 106 before and after the static charger 112*b*. The pinch rollers 111*a* and 111*b* together constitute a register portion (a portion corresponding to register rollers) having the function of receiving the fed recording paper 127 and looping it in a guide 113 to thereby improve the orthgonality of the leading end of the recording sheet 127 to the direction of arrow $X_1$. The recording sheets 127 are fed out one by one from a cassette 126 by a motor 140 and a paper feed roller 116, and are directed to the aforementioned portion corresponding to register rollers while being nipped between a conveying roller 114 and a pinch roller 115. The reference numeral 117 designates a web for wiping off the ink adhering to the belt 106 and the discharge port surfaces of the recording heads 101*a*, 101*b*, 101*c* and 101*d*. This web 117 is wound from a web supply roll 135 onto a belt cleaning roller 129 bearing against the belt 106 with a load of the order of 100 g, whereafter it comes to discharge port cleaning rollers 131*a*, 131*b*, 131*c* and 131*d* bearing against the discharge ports of the recording heads 101*a*, 101*b*, 101*c* and 101*d*, and is finally taken up onto a web take-up roll 132. This web take-up roll 132 is driven by a motor 133 through a reduction gear 134. The reference numeral 118 denotes a paper exhausting tray movable in the directions of arrows $X_1$ and $X_2$ by paper exhausting tray moving means 138.

The reference numeral 120 designates a driver for driving the recording heads 101*a*, 101*b*, 101*c* and 101*d*, the reference numerals 121, 123 and 136 denotes motor drivers for driving the motors 108, 140 and 133, respectively, the reference numeral 122 desinates a static charger driver for driving the static chargers 112*a* and 112*b*, the reference numeral 125 denotes cap moving means for moving the caps 103*a*, 103*b*, 103*c* and 103*d* in the directions of arrows $X_1$ and $X_2$, and the reference numeral 128 designates a pump driver for driving pumps 137*a*, 137*b*, 137*c* and 137*d*. The reference numeral 119 denotes a control circuit which controls the head driver 120, the motor drivers 121, 123, 136, the static charger driver 122, the head moving means 124, the cap moving means 125 and the pump driver 128, and effects the control of the dry-out detection and recovery operation which will be described later.

FIG. 2 is a perspective view of the recording head 1 (101) used in the present liquid jet recording apparatus, and the other recording heads are similar thereto and therefore are not shown.

The reference numeral 4 designates a substrate member on which at least one element for applying heat energy to the ink is provided correspondingly to one discharge port (said element is not shown). A plurality of discharge ports are juxtaposed lengthwisely of the recording head 1 (101), and when heat energy is applied from said element to the ink in conformity with an image signal, the ink is discharged from the discharge ports. The reference numeral 5 denotes an ink chamber comprising ink flow paths continuing from the discharge ports and a common liquid chamber for supplying the ink to the ink flow paths (neither of the ink flow paths and the common liquid chamber is shown). The ink is suitably supplied from an ink reservoir, not shown, to the ink chamber 5. The reference numeral 3 designates a support member partly adhesively secured to the substrate member 4.

The recording head 1 (101) is adhesively secured to the heat pipe 2, and is directed in direction opposed to a recording medium 11 (127). The ink is discharged from the discharge ports to the recording medium 11 (127) in comformity with an image signal, whereby an image is recorded on the recording medium. The reference numeral 10 denotes a fan for supplying wind to fins 9 in accordance with the command of a control circuit 6. Two temperature sensors 7 and 7*a* are mounted respectively near the center of the heat pipe and between the vicinity of the fins 9 and the support member 3, and effect temperature detection. The control circuit 6 is connected to the temperature sensors 7 and 7*a*, and receives the temperatures detected by these temperature sensors 7 and 7*a*. The control circuit 6 is also connected to a heater 8 and the fan 10, and adjusts the applied electric power to the heater 8 and fan 10 or the ON-OFF time interval thereof in accordance with the temperature detected by the temperature sensor 7.

The control circuit 6 effects the following control, in addition to the above-described control. That is, in a state in which the heat pipe 2 is operating normally, the difference between the temperatures detected by the temperature sensors 7 and 7*a* is very stable at about 1.5° C., and from this, the control circuit 6 judges the dry-out state when this temperature difference exceeds a predetermined value, e.g. 5° C. During the dry-out, the control circuit outputs a recovery signal which will be described later, and enters the recovery operation of the recording heads 101*a*, 101*b*, 101*c* and 101*d*, which thus discharge hot ink, whereby the recording heads are rapidly returned from the dry-out state to the possibility of normal recording.

The operation of the liquid jet recording apparatus thus constructed will now be described.

Figure 8:
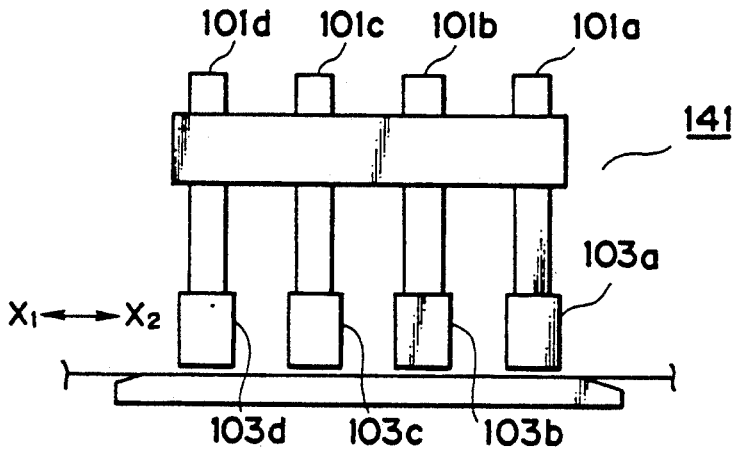
FIGS. 8, 9, 10 and 11 are schematic views sequentially showing the recovery operation of the recording head.

FIG. 8 shows the OFF state of the power source, and the discharge port surfaces of the recording heads 101*a*, 101*b*, 101*c* and 101*d* are capped by caps 103*a*, 103*b*, 103*c* and 103*d*, respectively, whereby the evaporation of the ink from the ends of the nozzles is prevented.

Figure 9:
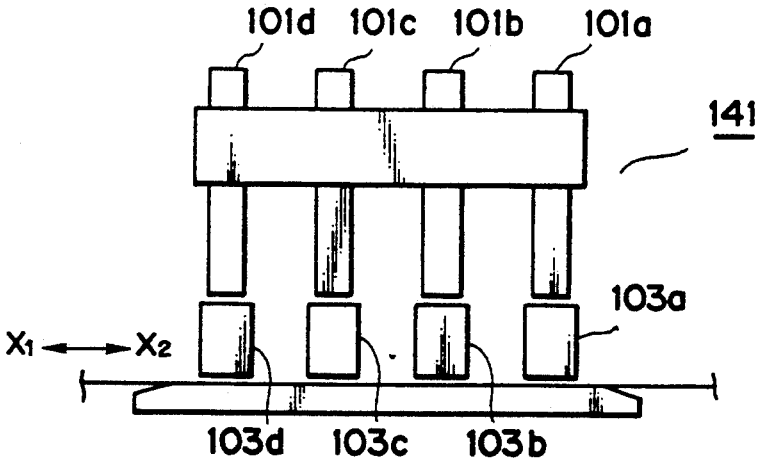
Figure 10:
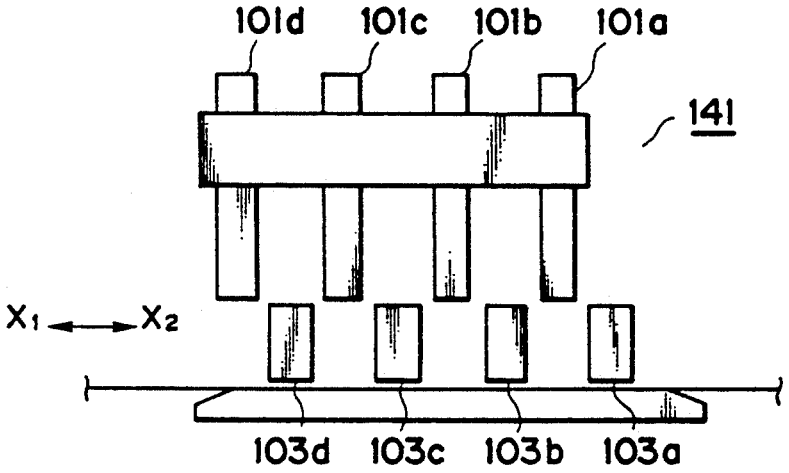
Figure 11:
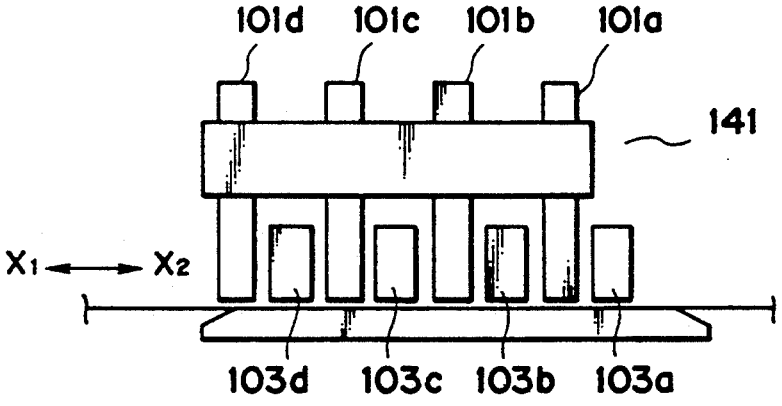

When the power source is switched on from this state, the head unit 141 is first raised by the order of 1 mm by the head moving means 124 (FIG. 9). When a recovery signal is present in this state, the recovery operation is entered as follows. The head unit 141 and the paper exhausting tray 118 are moved in the direction of arrow $X_1$ by the head moving means 124 and the paper exhausting tray moving means 138, respectively, and are stopped when the recording heads 101*a*, 101*b*, 101*c* and 101*d* come to positions opposed to the discharge port cleaning rollers 131*a*, 131*b*, 131*c* and 131*d*, respectively. In that state, the pumps 137*a*, 137*b*, 137*c* and 137*d* are driven to cause the ink increased in viscosity to be discharged from the nozzles. While the ink is discharged, the motor 133 is driven to feed the cleaning web 117 at a speed of the order of 20 mm/sec. The pumps 137*a*, 137*b*, 137*c* and 137*d* are stopped after operated for about 0.5 sec. Thereafter the head unit 141 is lowered and the discharge port surfaces of the recording heads bear against the discharge port cleaning rollers 131*a*, 131*b*, 131*c* and 131*d*, respectively. In that state, the web 117 is fed for about 0.2 sec. to wipe off the ink adhering to the discharge ports. After the feeding of the web 117 is stopped, the head unit 141 is raised, and then moved in the direction of arrow $X_2$ and when as shown in FIG. 10, the recording heads 101*a*, 101*b*, 101*c* and 101*d* come to the positions among the caps 103*a*, 103*b*, 103*c* and 103*d*, the head unit is lowered as shown in FIG. 11 and becomes ready for recording. Of course, the discharge of the ink is not limited to the pressurization by the pumps, but may also be done by a construction in which negative pressure is created from the cap side, whereby the ink in the recording heads is sucked and discharged.

When the recovery signal is absent, the head unit is immediately moved from the position of FIG. 10 to the position of FIG. 11.

Subsequently, the paper feed motor 140 is energized and a recording sheet 127 is picked from within the cassette 126 by the paper feed roller 116 and is directed to the guide 113, and then is nipped between the conveying roller 114 and the pinch roller 115. The leading end of the recording sheet 127 has its passage detected by a photosensor, not shown, provided immediately before the register portion, and in a predetermined time after the leading end arrives at the register portion, the paper feed motor 140 is deenergized. At this time, that portion of the recording sheet 127 which has been excessively fed makes a loop in the space of the angled guide 113, and due to the rigidity of the recording sheet 127, the leading end thereof follows the register portion, whereby the orthgonality thereof to the direction of conveyance is secured.

Subsequently, the belt motor 108 and the static chargers 112*a* and 112*b* are energized, and the recording sheet 127 is directed to the static charger 112*b* while being urged against the belt 106 by the pinch roller 111*a*. The belt 106 has its surface charged to the order of 1500 V by the static charger 112*a*, and negative charges are introduced into the recording sheet 127 by the static charger 112*b* and the recording sheet 127 is attracted to the belt 106 by the electrostatic power with the positive charges on the surface of the belt 106. This attraction is made more reliable by the recording sheet being urged against the pinch roller 111*b* after it has passed the static charger 112*b*. The feeding of the recording sheet 127 is counted in synchronism with the starting of the belt motor 108, and the recording of respective colors is effected from a point of time at which the leading end of the recording sheet 127 has arrived at the respective recording heads 101*a*, 101*b*, 101*c* and 101*d*.

The recording sheet 127 on which recording has been completed is curvature-separated from the belt 106 at the region of the belt driving roller 107 and is exhausted onto the paper exhausting tray 118. After the paper exhausting has been terminated, the belt motor 108 is deenergized and the static chargers 112*a* and 112*b* are also deenergized.

If here, the next recording is not effected, the head unit 141 is raised (FIG. 10) and the caps 103*a*, 103*b*, 103*c* and 103*d* are set (FIG. 9), and then the head unit 141 is lowered and the recording heads are capped by the caps 103*a*, 103*b*, 103*c* and 103*d* (FIG. 8), and the power source is switched off.

Also, if the recording of the next page is to be effected, the presence or absence of an idle discharge signal is detected, and if the signal is present, the paper feed motor 140 is energized after idle discharge onto the belt 106 is effected between recording sheets, and if the signal is absent, the paper feed motor 140 is immediately energized, and a recording sequence similar to that for the first recording sheet is repeated. The ink idly discharged onto the belt 106 is wiped off by the web 117 fed at a speed of the order of 5 mm/sec. In this case, idle discharge is effected for each sheet, and one cycle of idle discharge can be effected at several pulses and can be accomplished sufficiently in the space between recording sheets, and does not spoil the throughput in continuous paper feeding, i.e., the recording speed. Also, assuming that idle discharge is effected at a discharge frequency of 2.5 kHz and 500 pulses, the web 117 is fed by 1 mm per recording sheet, and if a web having a length of 10 m is prepared, it can cope with 10,000 recording sheets. Assuming that the recovery operation takes place once per 100 recording sheets, a length of 1.4 m can cope with 10,000 recording sheets. Accordingly, a total of about 12 m can accomplish cleaning for 10,000 recording sheets.

Although the present embodiment has been described as being provided with two temperature sensors, the present invention is not restricted thereto, but more than two temperature sensors may be provided.

In such case, when the difference between the temperature detected by the sensor nearest to the cooling portion, i.e., the fins, and the temperature detected by any other sensor reaches a predetermined value or greater, the recovery operation is performed, whereby control of higher accuracy is possible. The longer is the web, the higher is the effect.

As described above, the present invention detects the dry-out state of the heat pipe in a pseudo manner by measuring the temperature thereof, enters the forced recovery operation of the recording heads and discharges heated ink, whereby the apparatus not only can rapidly return from the dry-out state, but also does not require any special means or construction and therefore, can realize compactness, low costs and a sufficient recording performance.

Still another embodiment of the present invention will now be described with reference to the drawings.

Figure 12:
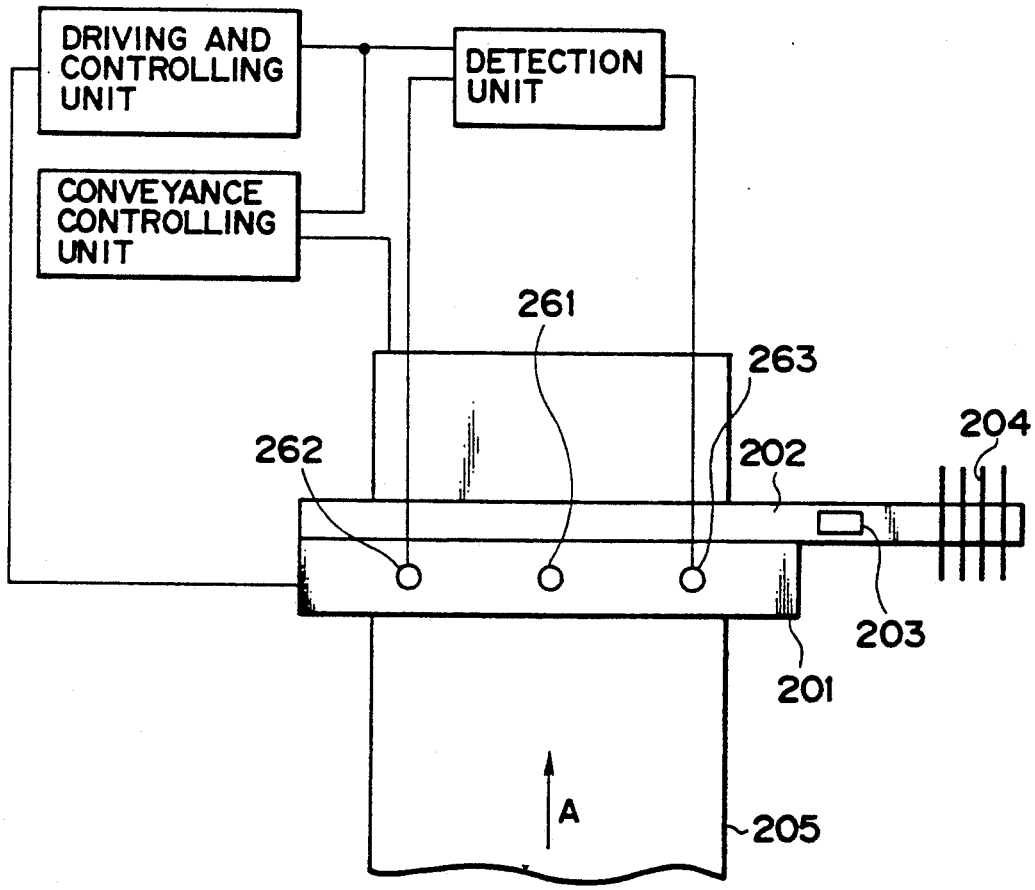
FIG. 12 is a schematic plan view showing the construction of still another embodiment of the present invention.

FIG. 12 is a plan view showing still another embodiment of the present invention.

In the present embodiment, above a cut recording sheet 205 conveyed in the direction of arrow A, there is fixedly disposed a liquid jet recording head 201 which is a thermal recording head having a plurality of electrothermal conversion members, not shown, juxtaposed in a direction orthogonal to the direction of conveyance A. The liquid jet recording head 201 of the present embodiment is a full multi-head for format A4 having a discharge port pitch 400 dpi and 3,328 discharge ports. In this liquid jet recording head 201, three temperature detecting elements 261, 262 and 263 for detecting the temperature of the liquid jet recording head 201 are disposed at intervals with the temperature detecting element 261 as the center, along the direction in which the electro-thermal conversion elements are juxtaposed, and further, there is integrally mounted a heat pipe 202 of a pipe diameter 9.7$\phi$ and a maximum heat transporting amount 40 W having at one end thereof a protruded portion protruded sideways from the liquid jet recording head 201. On the protruded portion of this heat pipe 202, there are mounted a temperature control heater 203 for heating the liquid jet recording head 201 through the heat pipe 202 and heat radiation fins 204 for radiating the heat transferred from the liquid jet recording head 201. The heat radiation fins 204, together with a blower, not shown, constitute cooling means, and are cooled by the blower and effect heat radiation. Also, in the present embodiment, provision is made of temperature control means, not shown, for driving the temperature control heater 203 or the blower in accordance with the temperature detected by the temperature detecting element 261 disposed in the central portion of the liquid jet recording head 201. By this temperature control means, the liquid jet recording head 201 radiates heat or is heated through the heat pipe 202, whereby it is kept at a predetermined temperature (45° C.–47° C.). The image recording apparatus of the present embodiment is further provided with printing speed control means for finding the temperature difference across the liquid jet recording head 201 from the temperatures detected by the temperature detecting elements 262 and 263 disposed on both sides of the central temperature detecting element 261, and widening the conveyance interval of the recording sheet 205 when the temperature difference exceeds a predetermined temperature difference, that is, when a partial temperature rise occurs in the liquid jet recording head 201, and is designed to vary the printing speed by widening the conveynace interval of the recording sheet 205.

The operation of the present embodiment will now be described.

Here, consider cases where for cut recording sheets 205 of format A4, the conveyance interval of the recording sheets 205, i.e., the distance between the recording sheets during the conveyance thereof, is 60 mm and the recording speed is about 30 CPM and half tones of printing duties 60% and 80% are recorded on 100 sheets on end at a printing frequency 2 kHz.

FIG. 13 shows variations in the temperatures detected by the temperature detecting elements 262 and 263, i.e., variations in the temperature across the liquid jet recording head 201, during the recording operation in these cases.

Figure 13A:
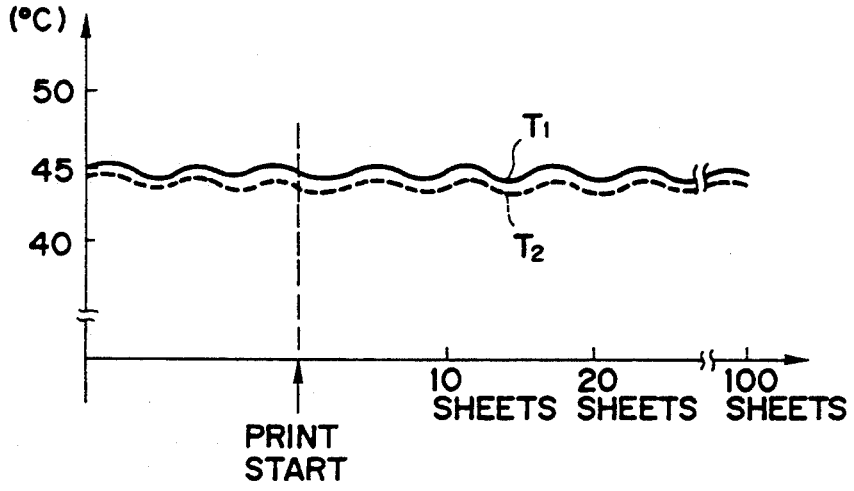
FIGS. 13A and 13B are characteristics graphs showing variations in the temperature of the recording head shown in FIG. 12.

FIG. 13A shows a variation in temperature when half tone of printing duty 60% was printed, and in this case, the variation in the temperature of the liquid jet recording head 201 was small, and the temperature difference between the detected temperatures $T_1$ and $T_2$ by the temperature detecting elements 262 and 263 was 2° C. or below at all times from the point of time at which printing was started until the termination of the printing, and the liquid jet recording head 201 was kept at a predetermined temperature (45° C.–47° C.), whereby uniform image recording free of density irregularity could be accomplished.

Figure 13B:
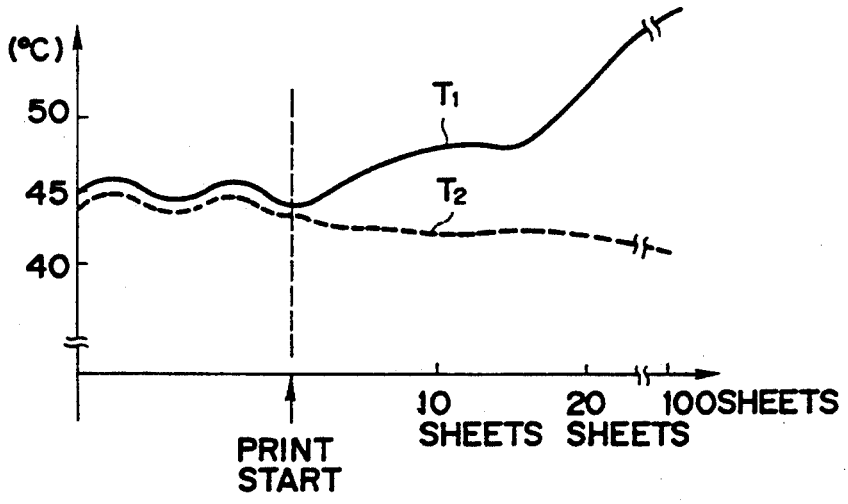
Figure 14:
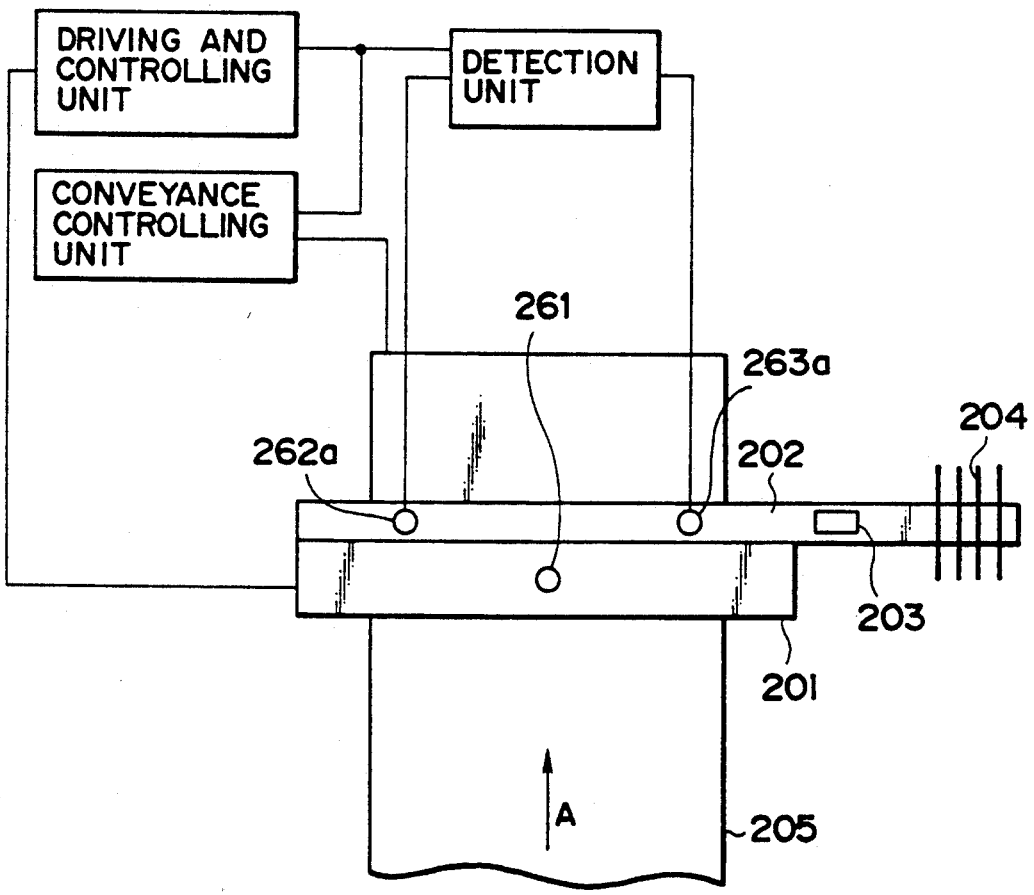
FIG. 14 is a schematic plan view showing the construction of yet still another embodiment of the present invention.

In contrast, FIG. 13B shows a variation in temperature when half tone of printing duty 80% was printed. In this case, the detected temperature $T_2$ by the temperature detecting element 263 is small in fluctuation and substantially constant, while the detected temperature $T_1$ by the temperature detecting element 262 rises greatly immediately after the start of printing, and when the recording progresses up to 215 or more recording sheets 205, the temperature rise becomes more vehement, and with this temperature rise, the temperature difference between the detected temperatures $T_1$ and $T_2$ by the temperature detecting elements 262 and 263 becomes 5° C. or higher immediately after the start of printing, and further widens as the printing progresses.

In the liquid jet recording head 201, heat is generated in conformity with the temperature rise, and when the amount of heat thereof increases and exceeds the maximum heat transporting amount (40 W) of the heat pipe 202, the heat conduction of the heat pipe 202 is aggravated and the heat radiation effect by the aforedescribed cooling means is reduced and thus, a temperature difference occurs in the heat pipe 202. When the amount of heat generated in the liquid jet recording head 201 further increases, the heat pipe 202 assumes its dry-out state and heat conduction becomes impossible and thus, the temperature difference becomes vehement.

The temperature difference between the detected temperatures $T_1$ and $T_2$ in the liquid jet recording head 201 by the temperature detecting elements 262 and 263 affects the temperature difference occurring in the heat pipe 202 and therefore, it is necessary that the amount of heat generated by the liquid jet recording head 201 which is the cause of the temperature difference in the heat pipe 202 be decreased before the heat pipe 202 assumes its dry-out state.

For this reason, in the present embodiment, when in the control means, the temperature difference between the detected temperatures $T_1$ and $T_2$ by the temperature detecting elements 262 and 263 reaches 4° C. considered to be the temperature difference before the heat pipe 202 assumes its dry-out state, the conveyance interval of the recording sheets 205, i.e., the distance between the recording sheets 205, is increased to extend the time during which printing is not effected between the recording sheets 205, thereby achieving an increase in the heat radiation effect during that time.

Here, if the detected temperatures $T_1$ and $T_2$ by the temperature detecting elements 262 and 263 are $T_1-T_2<4°$ C., the conveyance interval $\alpha_1$ of the recording sheets 205 is determined to 60 mm as previously described, and if said temperatures $T_1$ and $T_2$ are $T_1-T_2\geqq 4°$ C., the conveyance interval $\alpha_1$ of the recording sheets 205 is determined to 120 mm.

By this control, the average amount of heat generated by the liquid jet recording head 201 before the occurrence of the dry-out of the heat pipe 202 could be decreased by about 20%, and even when images of printing duty as high as 80% or more were recorded on end, the dry-out of the heat pipe 202 did not occur and the temperature difference of the liquid jet recording head 201 was held down within 3° C. and uniform images free of density irregularity could be obtained.

Yet still another embodiment of the present invention will now be described.

The construction of this embodiment is similar to that of the aforedescribed embodiment.

In the aforedescribed embodiment, the conveyance interval of the recording sheets 205 is widened in the control means to thereby suppress the heat generation of the liquid jet recording head 201, whereas in the present embodiment, the printing frequency of the liquid jet recording head 201 is varied.

Where the printing frequency is varied, it is necessary to vary the conveyance speed of the recording sheet 205 correspondingly thereto and therefore, in the present embodiment, if the detected temperatures $T_1$ and $T_2$ by the temperature detecting elements 262 and 263 are $T_1-T_2<4°$ C., the conveyance speed of the recording sheet 205 is determined to 130 mm/S for a printing frequency 2 kHz, and if said temperatures $T_1$ and $T_2$ become $T_1-T_2\geqq 4°$ C., the conveyance speed of the recording sheet 205 is determined to 100 mm/S for a printing frequency 1.5 kHz.

By this control, the discharge interval of the recording liquid by the liquid jet recording head 201, i.e., the driving interval of the electro-thermal conversion members, is lengthened and in the meantime, the heat radiation effected through the heat pipe 202 is expedited and the average amount of heat generated by the liquid jet recording head 201 can be suppressed and thus, as in the aforedescribed case, uniform images free of density irregularity can be obtained.

Where the printing frequency is varied as in the present embodiment, the recording paper 205 may effectively be a cut sheet or continuous paper.

A further embodiment of the present invention will now be described.

In the aforedescribed embodiments, the temperature detecting elements 261, 262 and 263 are disposed on the liquid jet recording head 201, whereas in the present embodiment, the central temperature detecting element 261 is likewise disposed on the central portion of the liquid jet recording head 201 and the other temperature detecting elements are disposed as temperature detecting elements **262*a* and 263*a*** at locations on the heat pipe 202 which correspond to the opposite end portions of the liquid jet recording head 201. In the present embodiment, as in the aforedescribed embodiments, the temperature control means drives the temperature control heater 203 or the cooling means in accordance with the detected temperature by the central temperature detecting element 261, but the printing speed control means finds the difference between the detected temperatures by the temperature detecting elements 262*a* and 263*a* disposed on the heat pipe 202, and varies the printing speed if the found temperature difference exceeds a set value.

As previously described, the temperature difference in the liquid jet recording head 201 is affected by the temperature difference in the heat pipe 202 caused by the heat generated by the liquid jet recording head 201 and therefore, as in the present embodiment, the temperature detecting elements 262*a* and 263*a* are disposed on the heat pipe 202 and detect any variation in the temperature thereof, whereby the variation in the temperature of the heat pipe 202 conforming to the heat transferred to the heat pipe 202 by the temperature rise of the liquid jet recording head 201 can be accurately detected and the dry-out state of the heat pipe 202 can be prevented more reliably.

While each of the above-described embodiments has been shown as using a liquid jet recording head, the present invention is effective for all of recording apparatuses using electro-thermal conversion members, such as thermosenstive or heat transfer recording apparatuses.

As described above, the present invention achieves the following effects.

When the temperature control of the recording head effected through the heat pipe is impossible due to the occurrence of the dry-out caused by overheated condition, the printing speed is varied to suppress the amount of heat generated from the recording head and therefore, the temperature of the recording head can be reduced, whereby the dry-out state of the heat pipe can be eliminated. Thereby, the abnormal temperature rise of the recording head can be prevented and the recording head can always be maintained at a constant temperature and the uniformization of the temperature of the recording head becomes possible and thus, image recording of high quality free of density irregularity can be accomplished.

Where the temperature detecting elements are disposed on the heat pipe, a variation in the temperature of the heat pipe conforming to the amount of heat transferred thereto from the recording head can be directly detected and therefore, the accuracy of the detection of the actual heat transporting amount in the heat pipe is improved and the recording condition of the recording head can be changed on the spot and thus, the dry-out state of the heat pipe caused by an increase in the amount of heat generated by the recording head can be reliably avoided and the reliability of the recording operation is improved.

As the printing speed, the conveyance interval of the recording sheets or the printing frequency is varied, whereby the driving interval of the electro-thermal conversion members juxtaposed in the recording head can be varied, and by that interval, the heat radiation of the recording head can be expedited to suppress the heat generation. Particularly, where the printing frequency is varied, the recording paper may effectively be a cut sheet or continuous paper.

The present invention brings about excellent effects particularly in the bubble jet type recording head and recording apparatus proposed by Canon, Inc., among the ink jet recording systems.

As regards the typical construction and principle thereof, use may preferably be made of the basic principles disclosed, for example, U.S. Pat. No. 4,723,129 and U.S. Pat. No. 4,740,796. This system is applicable to both of the so-called on-demand type and the so-called continuous type, and particularly in the case of the on-demand type, the present invention is effective because at least one driving signal corresponding to recording information and providing a rapid temperature rise exceeding nucleate boiling is applied to electro-thermal conversion members disposed correspondingly to a sheet or liquid paths retaining liquid (ink) therein, whereby heat energy is generated in the electro-thermal conversion elements and film boiling is caused on the heat-acting surface of the recording head with a result that a bubble in the liquid (ink) corresponding at one to one to said driving signal can be formed. By the growth and contraction of this bubble, the liquid (ink) is discharged through a discharge opening to thereby form at least one droplet. If the driving signal is in the form of a pulse, the growth and contraction of the bubble appropriately will take place on the spot and therefore, discharge of the liquid (ink) excellent particularly in responsiveness can be accomplished, and this is more preferable. As this driving signal in the form of pulse, one as described in U.S. Pat. No. 4,463,359 or U.S. Pat. No. 4,345,262 is suitable. More excellent recording can be accomplished if the conditions described in U.S. Pat. No. 4,313,124 which discloses an invention relating to the temperature rise rate of said heat-acting surface are adopted.

As regards the construction of the recording head, besides the construction comprising a combination of discharge ports, liquid paths and electro-thermal conversion members as disclosed in the above-mentioned patents (straight liquid flow-paths or right-angled liquid flow paths), the construction using U.S. Pat. No. 4,558,333 and U.S. Pat. No. 4,459,600 which disclose a construction in which the heat-acting portion is disposed in a bent area is also covered by the present invention. In addition, the present invention will also be effective if it adopts a construction based on Japanese Laid-Open-Patent Application No. 59-123670 which discloses a construction in which a slit common to a plurality of electro-thermal conversion members is the discharge portion of the electro-thermal conversion members or Japanese Laid-Open Patent Application No. 59-138461 which discloses a construction in which an opening for absorbing the pressure wave of heat energy corresponds to a discharge portion.

Further, the full line type recording head having a length corresponding to the width of the largest recording medium on which the recording apparatus can effect recording may be used with any of the constructions as disclosed in the above-mentioned publications wherein the length is satisfied by a combination of a plurality of recording heads and a construction as a single recording head formed as a unit, and the present invention can display the above-noted effects more effectively.

In addition, the present invention is effective for a case where use is made of an interchangeable chip type recording head which enables the electrical connection to an apparatus body or the supply of ink from the apparatus body to be accomplished by being mounted on the apparatus body or a recording head of the cartridge type in which a cartridge is integrally provided in the recording head itself.

Also, the addition of recovery means, preliminary auxiliary means and the like for the recording head which is provided as the construction of the recording apparatus of the present invention is preferable because it can further stabilize the effects of the present invention. Specifically, they include capping means, cleaning means and pressing or suction means for the recording head, and preheating means provided by electro-thermal conversion members or a heating element discrete therefrom or a combination of these. It is also effective for accomplishing stable recording to perform a preliminary discharge mode in which discharge discrete from that for recording is effected.

Further, the recording mode of the recording apparatus is not limited to a recording mode only in the main color such as black, but the present invention is also very effective for an apparatus provided with at least one of different plural colors or full color by mixed colors although the recording head may be constructed as a unit or as a combination of a plurality of heads.

In the embodiments of the present invention described above, liquid ink has been described as being used, but in the present invention, use may also be made of ink which is in liquid phase at room temperature or ink which is softened at room temperature. In the above-described ink jet apparatus, it is usual to effect temperature adjustment of the ink itself within the range of 30° C. to 70° C. and effect temperature control so that the viscosity of the ink may be within a stable discharge range and therefore, the ink may be one which forms the liquid phase when the recording signal used is imparted. In addition, the temperature rise by heat energy may be prevented by being positively used as the energy for the phase change of the ink from the solid phase to the liquid phase, or ink which solidifies when it is left as it is may be used with a view to prevent the evaporation of the ink, and in any case, the use of ink having the nature of being liquefied only by heat energy, such as ink which is liquefied by the application of heat energy conforming to a recording signal and is discharged in the form of ink liquid or ink which already begins to solidify at a point of time whereat it arrives at a recording medium is also applicable to the present invention. In such a case, the ink may be in a form opposed to electro-thermal conversion members in the state as described in Japanese Laid-Open Patent Application No. 54-56847 or Japanese Laid-Open Patent Application No. 60-71260 wherein the ink is retained as liquid or solid in the recesses of a porous sheet or through-holes. In the present invention, what is most effective for the above-described kinds of inks is what executes the above-described film boiling system.

We claim:

1. An ink jet recording apparatus for effecting recording with ink caused to adhere to a recording medium, having:

an ink jet recording head unit having a recording head in which a plurality of electro-thermal conversion elements available to discharge the ink are arranged, heat exchange means having a first heat exchange portion contacting with the whole area of one side of said recording head in the lengthwise direction thereof effecting heat exchange and a second heat exchange portion provided in continuation to said first heat exchange portion and extending on the outside far from said recording head, heating means provided near said second heat exchange portion for heating said heat exchange means, and temperature detecting means provided on a portion of said first heat exchange portion;

said second heat exchange portion being inclined upwardly relative to said recording head;

cooling means for acting on said second heat exchange portion of said heat exchange means and assisting the heat radiation of said second heat exchange portion; and drive control means for controlling the driving of said cooling means and/or said heating means on the basis of the temperature detected by said temperature detecting means.

2. An ink jet recording apparatus according to claim 1, wherein said heat exchange means is generally inclinedly mounted so that said second heat exchange portion may be disposed above said recording head.

3. An ink jet recording apparatus for recording by depositing ink onto a recording medium, said apparatus comprising:

an ink jet recording head unit including a recording head having a plurality of electrothermal converting elements used for discharging ink through a plurality of discharge ports, said recording head having at least one longitudinal side having a surface area, heat exchanging means including a first heat exchanging section for exchanging heat by contacting said recording head at the entire surface area of the at least one longitudinal side of said recording head and a second heat exchanging section continuing from said first head exchanging section and extending outside and remote from said recording head, and a first temperature sensor provided at a part of said first heat exchanging section; and control means for causing forcible exhaustion of ink from said recording head after stopping recording by said recording head when the temperature detected by said first temperature sensor is over a predetermined value.

4. An ink jet recording apparatus according to claim 3, wherein said first temperature sensor is provided on the substantially central portion of said heat exchanging means with respect to the longitudinal direction thereof and a second temperature sensor is provided on the area between said first heat exchanging section and said second heat exchanging section, and causes said control means to perform the forcible ink ejection operation when the temperature difference between said first and second temperature sensors exceeds a predetermined range.

5. An ink jet recording apparatus according to claim 3, wherein said control means includes pressurizing means for applying pressure to the ink in said recording head to thereby discharge the ink said discharge ports.

6. An ink jet recording apparatus according to claim 3, wherein said control means is provided with a cap member for bearing against the discharge ports of said recording head, and has suction means for producing negative pressure in said cap member and for exhausting the ink from said discharge ports.

7. An ink jet recording apparatus for recording by depositing ink onto a recording medium, said apparatus comprising:

an ink jet recording head unit including a recording head having a plurality of electrothermal converting elements used for discharging ink, said recording head having at least one longitudinal side having a surface area, heat exchanging means including a first heat exchanging section for exchanging heat by contacting said recording head at the entire surface area of the at least one longitudinal side of said recording head and a second heat exchanging section continuing from said first heat exchanging section and extending outside and remote from said recording head, and a first temperature sensor provided at a part of said first heat exchanging section; and control means for changing a recording speed of said recording head when a temperature detected by said first temperature sensor is over a predetermined value.

8. An ink jet recording apparatus according to claim 7, wherein said first temperature sensor is provided on the area between said first heat exchanging section and said second heat exchanging section of said heat exchanging means and a second temperature sensor is provided on an end portion area of said first heat exchanging section which is opposite to said second heat exchanging section, for detecting if the temperature difference between these areas exceeds a predetermined range, thereby reducing the recording speed of said recording head by said control means.

9. An ink jet recording apparatus according to claim 7, wherein said first temperature sensor is provided on an area of said recording head which corresponds to the area between said first heat exchanging section and said second heat exchanging section and a second temperature sensor is provided at the end portion area of said first heat exchanging section which is opposite to said second heat exchanging section, for detecting if the temperature difference between these areas exceeds a predetermined range, thereby reducing the conveyance speed of the recording medium by said control means.

10. An ink jet recording apparatus according to claim 7, wherein said control means adjust a conveyance interval of the recording medium to thereby effect the control of reducing the recording speed.

11. An ink jet recording apparatus according to claim 7, wherein said control means adjusts the driving frequency of said recording head to thereby effect the control of reducing the recording speed.

* * * * *

UNITED STATES PATENT AND TRADEMARK OFFICE

CERTIFICATE OF CORRECTION

PATENT NO. : 5,231,423

DATED : July 27, 1993

INVENTOR(S) : MASAFUMI WATAYA, ET AL.

It is certified that error appears in the above-identified patent and that said Letters Patent is hereby corrected as shown below:

Title Page:

AT [57] ABSTRACT:

Line 4 "electrothermal" should read --electro-thermal--.

COLUMN 1:

Line 19, "small" should read --low--.

COLUMN 2:

Line 48, "to be accomplished" should be deleted.

COLUMN 10:

Line 65, "orthgonality" should read --orthogonality--.

COLUMN 11:

Line 20, "denotes" should read --denote--.

UNITED STATES PATENT AND TRADEMARK OFFICE

CERTIFICATE OF CORRECTION

PATENT NO. : 5,231,423

DATED : July 27, 1993

INVENTOR(S) : MASAFUMI WATAYA, ET AL.

It is certified that error appears in the above-identified patent and that said Letters Patent is hereby corrected as shown below:

COLUMN 12:

Line 44, "after" should read --after being--.

COLUMN 13:

Line 11, "orthgonality" should read --orthogonality--.

COLUMN 15:

Line 4, "conveynace" should read --conveyance--.

COLUMN 19:

Line 67, "thereof" should read --thereof and--.

Signed and Sealed this

Seventeenth Day of May, 1994

Bruce Lehman

BRUCE LEHMAN

*Commissioner of Patents and Trademarks*

*Attest:*

*Attesting Officer*